US011252997B2

(12) United States Patent
Zabaglo et al.

(10) Patent No.: US 11,252,997 B2
(45) Date of Patent: Feb. 22, 2022

(54) CIGAR VENTILATION IMPLEMENT

(71) Applicant: Synge LLC, Alexandria, VA (US)

(72) Inventors: Todd Zabaglo, Alexandria, VA (US); Frank Meyers, Alexandria, VA (US); Mansoor Riaz, Alexandria, VA (US); David Reeb, Sykesville, MD (US)

(73) Assignee: SYNGE LLC, Alexandria, VA (US)

( * ) Notice: Subject to any disclaimer, the term of this patent is extended or adjusted under 35 U.S.C. 154(b) by 204 days.

(21) Appl. No.: 16/598,066

(22) Filed: Oct. 10, 2019

(65) Prior Publication Data

US 2020/0352226 A1 Nov. 12, 2020

Related U.S. Application Data

(63) Continuation-in-part of application No. 16/403,997, filed on May 6, 2019.

(51) Int. Cl.
*A24F 13/24* (2006.01)
*A24F 13/26* (2006.01)

(52) U.S. Cl.
CPC ..... *A24F 13/26* (2013.01); *A24F 13/24* (2013.01)

(58) Field of Classification Search
CPC ..... A24F 13/24; A24F 13/26
USPC ..... 131/254
See application file for complete search history.

(56) References Cited

U.S. PATENT DOCUMENTS

| | | | | |
|---|---|---|---|---|
| 703,162 | A * | 6/1902 | Todd, Jr. | A24F 13/26 131/255 |
| 1,734,620 | A | 11/1929 | Gicopini | |
| 4,733,674 | A | 3/1988 | Sielck et al. | |
| 5,738,117 | A | 4/1998 | Fontaine, Jr. | |
| 5,836,318 | A | 11/1998 | Adams | |
| 5,852,808 | A | 12/1998 | Cherny | |
| 5,913,676 | A | 6/1999 | Kim | |
| 6,119,349 | A * | 9/2000 | Chuan | A24F 13/26 30/109 |
| 8,485,200 | B1 | 7/2013 | Levinger | |
| 2005/0257797 | A1* | 11/2005 | Taylor | A24F 13/26 131/248 |
| 2009/0133705 | A1 | 5/2009 | Smith | |
| 2009/0183743 | A1 | 7/2009 | Simmons et al. | |
| 2011/0146696 | A1 | 6/2011 | Dipple | |

FOREIGN PATENT DOCUMENTS

| | | |
|---|---|---|
| DE | 202018002142 U1 | 6/2018 |
| KR | 1999-099403 | 3/1999 |

* cited by examiner

*Primary Examiner* — Eric Yaary
*Assistant Examiner* — Russell E Sparks
(74) *Attorney, Agent, or Firm* — Bacon & Thomas, PLLC

(57) ABSTRACT

A cigar ventilating implement includes both a cylindrical punch and a piercing member such as a needle or spike. The cylindrical punch and piercing member are extendable from a housing of the implement by gripping laterally extending flanges or pins and pressing on an actuator. One or two coil springs may be provided to bias the punch and/or piercing member to a retracted position, and a retaining member may be provided to latch the punch in the extended position.

14 Claims, 5 Drawing Sheets

CIGAR VENTILATION IMPLEMENT

This application is a continuation-in-part of U.S. patent application Ser. No. 16/403,997, filed May 6, 2019, and incorporated herein by reference.

BACKGROUND OF THE INVENTION

1. Field of the Invention

The invention relates to a cigar ventilation implement, and in particular to a cigar ventilation implement that includes both (i) a punch for forming an opening in a binder or wrapper at an end of the cigar, and (ii) an elongated piercing member such as a needle or spike for additionally forming an axial passage having a selectable depth. The punch enables removal of the binder or wrapper from an area coextensive with the end of the cigar in order to prepare the cigar for smoking, while the elongated piercing member enables the smoker to modify the passage of smoke through the cigar according to the user's preference in order to enhance the smoking experience.

2. Description of Related Art

Cigars are generally cylindrical rolls of tobacco characterized by cut, dried and fermented tobacco leaves encased in a binder and/or wrapper of relatively thicker leaves. Conventional cigars are typically formed with an open end, which is the end that is exposed to a flame in order to light the cigar, and a closed end. In order to prepare the cigar for smoking, the closed end must be cut, punched, or pierced to allow smoke-carrying air to be drawn from the lit open end through the main body of the cigar, the smoke-carrying air exiting the cigar into the smoker's mouth through the cut, punched or pierced end.

The most common method of ventilating a cigar in order to prepare it for smoking is to use a cutting implement, such as a guillotine-like cutter, to slice off the closed end of the cigar. However, slicing off the closed end can leave bits of loose tobacco that may end up in the smoker's mouth, and is a relatively wasteful way to achieve ventilation. In addition, cigar cutting implements are typically relatively large and require a degree of skill or dexterity to achieve an optimal cut that may be beyond that of the occasional smoker, the elderly, or disabled users. A bad cut cannot be reversed, and can ruin an expensive cigar.

Another known method of ventilating a cigar is to use a needle or spike to pierce the closed end of the cigar and form an axial passage. Such cigar-piercing spike or needle devices have a number of advantages over cigar cutters, including the relatively small size of the needle or spike, which allows it to fit on a keyring or otherwise to be easily carried, and the ability of the needle or spike to penetrate the cigar to a controllable depth, which can ameliorate the effects of a smaller diameter passage. In addition, use of a needle or spike to pierce the closed end of the cigar is less wasteful than cutting, and solves the problem of loose tobacco leaves. However, this alternative has the disadvantage, for true cigar aficionados, that the relatively small diameter of the passage for smoke prevents smoke from passing through the full cross-section of the cigar, which can result in a duller flavor and a less satisfying experience. The best cigars have specially selected leaves that differ along the length and/or diameter of the cigar, and cannot be fully experienced if the passage of smoke is limited to the diameter of a needle or spike.

Yet another known method of ventilating a cigar is to use a cylindrical cigar punch to removes a circular piece of the end wrapper and provide a relatively large diameter opening in the cigar end, thereby permitting a relatively large volume of smoke to pass through the entire cross-section of the cigar, while at the same time presenting. Unlike a cutter or piercing device, however, the cylindrical punch does not provide a way for the user to control the depth of the opening and thereby customize the smoking experience by controlling the passage of smoke through the cigar.

To overcome the above-described shortcomings of conventional cigar ventilating implements, the inventors of the improved cigar ventilation implement described herein have devised a way to combine a punch and a needle or spike-type piercing tool, in a single implement that does not require enhanced skills or dexterity to manipulate and that can easily be carried by the user. The improved cigar ventilation implement thus has advantages of both the punch and the piercing tool, including the formation of a relatively large-diameter opening to enable the full cross-section of the cigar to be enjoyed, and the provision of an axial passage having a controllable depth. Furthermore, the invention has additional advantages of providing for retraction into the device of both the punch and piercing implement to ensure safety, as well as an especially simple and easy-to-assemble construction in comparison with conventional cutters.

By way of background, U.S. Pat. No. 4,733,674 shows an example of a prior art plunger-actuated needle or spike-type cigar-piercing ventilating implement that includes a flange for providing leverage when operating the plunger in a manner similar to a medical syringe. The plunger-actuated ventilating implement operates in a manner similar to that of the invention, but without an additional extendable punch. Other examples of cigar piercing devices that utilize a needle or spike but that do not include an additional punch are found in U.S. Pat. Nos. 1,734,620 and 4,733,674, U.S. Patent Publication No. 2009/0183743, German Patent Publication No. DE 202018002142, and Korean Publication No. 1999-099403.

U.S. Pat. No. 5,852,808 is of interest because it includes both a fixed punch and a retractable needle. Because the punch is not extendable and retractable, the ventilating implement requires an additional screw-on cover to ensure that the cutting blade on the punch is not exposed when not in use. A similar arrangement of a piercing device with a cutting blade and a spike-like structure extendable into the cutting blade for pushing a cut plug out of the punch is disclosed in U.S. Patent Publication No. 2011/0146696.

On the other hand, U.S. Patent Publication No. 2009/0133705 discloses a cigar ventilator with fixed spike-like structure and a retractable cylindrical punch. However, the fixed spike-like structure at the center of the retractable cylindrical punch is used to eject the tobacco plug when the cylindrical punch is retracted, rather than serving as a retractable piercing device that is in addition to the retractable punch. U.S. Pat. No. 308,906, which issued in 1884, also shows a piercing device with a cutting blade and a punch that extends into the cutting blade for ejecting the cut plug.

Finally, by way of further background, U.S. Pat. No. 5,836,318 shows a cigar ventilating arrangement with a rotatable piecing device, U.S. Patent Publication No. 2010/0000553 discloses a cigar cutter with a rotatable piercing device that is combined with a pen, U.S. Pat. No. 925,158 discloses a combined cigar cutter and perforator, U.S. Pat. No. 8,485,200 discloses a combined cigar punch, flashlight, and keyring, and U.S. Pat. Nos. 5,738,117 and 5,913,676 are representative of numerous prior patents and publications that disclose a combined cigar cutter and lighter.

SUMMARY OF THE INVENTION

It is accordingly an objective of the invention to overcome the disadvantages of the prior art by providing a cigar ventilating implement that enables a user to prepare an end of the cigar for smoking by either piercing or punching the end of the cigar, or both, and yet that has a simple and reliable construction, is easy-to-use, and can be safely, conveniently, and discretely transported by the user so as to be available for use any time the user wishes to enjoy a cigar.

It is a further objective of the invention to provide a cigar ventilating implement that provides the user with the option of punch-cutting the end of a cigar, piercing it, or a combination of punching and piercing according to the user's preference, in order to optimize cigar preparation for different types of cigar, with minimal risk of a cutting error that might ruin the cigar.

It is also an objective of the invention to provide a cigar ventilating implement that meets at least one of the above objectives and yet that is relatively inexpensive to manufacture or assemble.

These objectives are achieved, in accordance with a preferred embodiment of the invention, by a cigar ventilating implement that includes both a cylindrical punch and a piercing member such as a needle or spike, arranged coaxially and each extendable from an outer housing of the implement by gripping laterally extending flanges and pressing on an actuator in a manner similar to that used to operate a medical syringe. In a preferred embodiment of the invention, the cylindrical punch is extendable to a predetermined distance when pushing the actuator over a first section of its total range, after which the piercing member may be extended by a further distance upon pushing the actuator over a second section of its total range. A coil spring is provided to ensure retraction of at least the piercing implement back into the cylindrical punch when pressure on the actuator is released, while retraction of the cylindrical punch into the outer housing may be achieved by pulling up on the actuator or pushing up on the punch, to enable safe transport and storage of the implement.

The objectives of the invention are also achieved, in accordance with a second preferred embodiment of the invention, by a cigar ventilating equipment that includes both a cylindrical punch and a piercing member arranged coaxially and extendable from an outer housing as in the first preferred embodiment. However, in this embodiment, the laterally extending flanges are replaced by pins that extend through a guide slot in the actuator, as well as dual bias springs, to provide enhanced stability and reliability. The guide slot has first and second vertical sections connected by an angled or sloped section that requires the user to rotate both the plunger/actuator and a punch retaining member, to lock the punch in an extended position before extending the piercing member. In addition, the cigar ventilating implement of the second preferred embodiment may include a punch cleaning disc.

In the preferred embodiments, the cigar ventilating implement requires only four main parts to provide both the retractable punch and the retractable elongated member, although those skilled in the art will appreciate that details of the construction may be varied by, for example, constructing the four main parts of separate units, or adding separate additional parts such as bushings, washers, o-rings. As a result, the detailed description and drawings included herein should not be considered as limiting, variations or modifications of the illustrated embodiment being possible without departing from scope of the invention.

Although illustrated below as a stand-alone device or implement, the cigar ventilating implement of the invention may be combined with a lighter or any other object or device, including by way of example and not limitation, a conventional cigar cutter, a pocket or utility knife, a key ring, and/or a flashlight.

Finally, it is to be understood that, in the following description, the terms "vertical," "horizontal," "upper," and "lower" are arbitrary designations to distinguish an axial direction of the implement, punch, and piercing member (the "vertical" direction, with the end from which the punch and piercing member are extended being the "lower" end), and a direction that is perpendicular to the implement, punch, and piercing member axes

DETAILED DESCRIPTION OF THE PREFERRED EMBODIMENTS

Throughout the following description and drawings, like reference numbers/characters refer to like elements. It should be understood that, although specific exemplary embodiments are discussed herein there is no intent to limit the scope of present invention to such embodiments. To the contrary, it should be understood that the exemplary embodiments discussed herein are for illustrative purposes, and that modified and alternative embodiments may be implemented without departing from the scope of the present invention.

Figure 1:
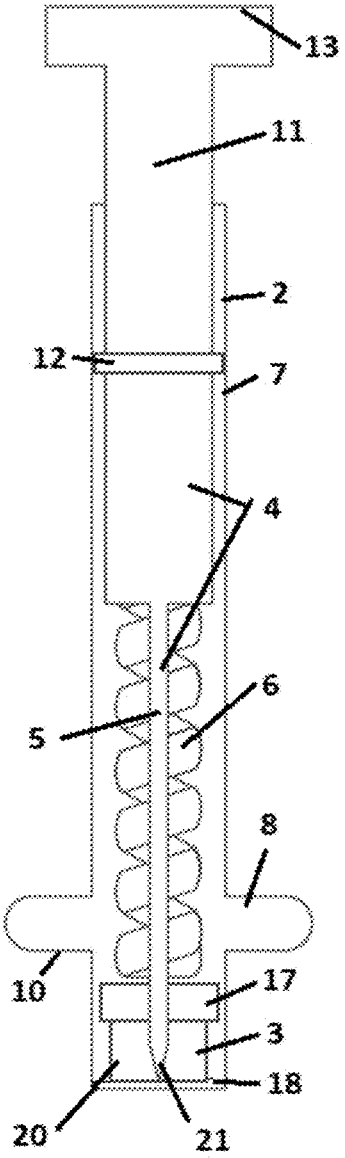
FIGS. 1-3 are cross-sectional side views of a cigar ventilation implement constructed in accordance with the principles of a first preferred embodiment of the invention.

As shown in FIG. 1, the cigar ventilation implement 1 of a preferred embodiment of the invention includes an outer housing 2, a cylindrical punch 3, an actuator/piercing member 4, and a coil spring 6.

Outer housing 2, illustrated in FIGS. 1-3, 5A, and 5B, includes a cylindrical main section 7 and a flange 8. The flange 8 extends in a generally perpendicular direction from a lower section 9 of the main section 7, and includes a lower surface 10 that is gripped by a user's fingers to provide resistance to forces caused by pushing on the actuator 4.

The actuator/piercing member 4, as illustrated in FIGS. 1-4, includes both a plunger section 11 and an elongated needle or spike-like piercing member 5. The plunger section 11 and piercing member 5 may be formed in one piece by, for example, plastic extrusion molding of a plastic material or metal casting, or may be formed separately, either of the same material or different materials, and joined together to form an integrated piece. As a result, it will be appreciated that numerous different materials and methods of construction of the actuator/piercing member 4 will occur to those skilled in the art, and that the invention should not be limited to any particular material(s) or method of construction or assembly.

As illustrated in FIGS. 1-4, the actuator/piercing member 4 is inserted into the outer housing 2 from a top end that is opposite the lower section 9 from which the flange 8 extends, and is axially movable within the outer housing 2. In order to support the plunger 11 and facilitate movement of the actuator/piercing member 4, an annular bearing 12 may be installed in the main body section 7 of the outer housing 1. Bearing 12 may be in the form of a washer, o-ring, detents extending from the inner surface of the outer housing 2, or any other structure capable of supporting the actuator/piercing member 4 for axial movement without excessive friction that would interfere with the axial movement.

The cylindrical punch 3, as illustrated in FIGS. 1-3, 7A and 7B, is also slidably positioned with respect to the outer housing 2, and is attached to the plunger 11 by coil spring 6 so that the elongated piercing member 5 extends coaxially through both the coil spring 6 and the cylindrical punch 3, and so that a tip 21 of the elongated piercing member 5 is initially situated near a lower end of the punch 3. An outwardly extending projection, collar or flange 17 at the top end of punch 3 engages a corresponding inwardly extending surface or lip 18 at the bottom end of the outer housing 2 to limit travel of the punch 3 in a downward direction.

The main body 20 of the punch is in the form of a cylinder that extends downwardly from the collar or flange 17, the distal end of the cylinder forming a cutting edge that cuts out a circular section of a the binder or wrapper covering the closed end of the cigar so that the binder or wrapper can be removed to enable passage of air and smoke. The distance between the bottom of collar or flange 17 and the cutting tip at the bottom of the main body 20 defines the maximum distance by which the cutting tip of the main body 20 will extend from the outer housing 2. This distance must be sufficient to enable punching of the cigar wrapper irrespective of the curvature of the cigar end. The material and manner of forming the punch 3 form no part of the invention, although metal punches are generally preferred as they are better able to maintain a cutting edge that can penetrate the cigar wrapper or binder.

The plunger 11 of the slidably positioned actuator/piercing member 4 includes an upper surface 13 that is engaged by the user's thumb when the lower surface 10 is gripped by fingers of the user, in a manner similar to the manner in which a medical syringe is gripped and operated. When the plunger is in a topmost position, the tip 21 of the needle or spike-like piercing member 5 is initially retracted into the punch 3, and the punch 3 is retracted into the outer housing 2. The punch 3 is attached to the plunger section 11 of the actuator/piercing member 4 solely by the coil spring 6, so that the punch 3 initially moves with the plunger 11 as the plunger 11 is pushed in a first direction, illustrated in FIGS. 1-3 as downward, from the initial topmost position shown in FIG. 1 to an intermediate position shown in FIG. 2, by pressing the upper surface 13 while gripping lower surface 10. Those skilled in the art will appreciate that the manner in which the coil spring 6 is attached to the plunger 11 and the punch 3 is optional and may be freely selected without departing from the scope of the invention.

Figure 2:
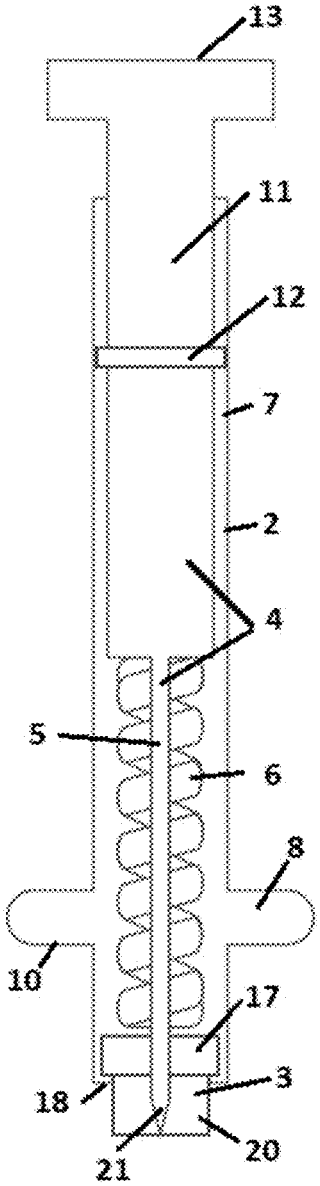

When the actuator/piercing member 4 has been pushed to the intermediate position shown in FIG. 2, the collar or flange 17 of the punch engages the lip or shoulder 18 of the outer housing 2. In this position, the punch 3 is fully extended from the outer housing 2, as shown in FIG. 2, but the tip 21 of the needle or spike-like piercing member 5 is still within the punch 3. Subsequently, further pushing on the upper surface 13 by the user of the plunger 11 in the first or downward direction is opposed to a bias force provided by the coil spring 6. This occurs because further downward movement of the cylindrical punch 3 is opposed by engagement of the flange 17 and lip or shoulder 18, resulting in compression of the coil spring 6 as the plunger 11 continues to be pushed downward. Since the needle or spike-like piercing member 5 is integral or formed in one piece with the plunger 11, the needle or spike-like piercing member 5 moves relative to the extended cylindrical punch 3, from the position shown in FIG. 2 to the position shown in FIG. 3. The position shown in FIG. 3 is the lowermost position of the piercing member 5, which determines the maximum depth that the piercing member can be extended into a cigar to form a passage, but the user is free to stop pushing on the plunger 11 at any point in between the position shown in FIG. 2 and the lowermost position shown in FIG. 3, thereby allowing the user to control the depth of the passage formed by penetration of the piercing member 5 into the cigar.

As described above, the initial pressure on the plunger 11 results in the extension of the cylindrical punch 3 in order to form an opening in the end of the cigar by cutting a circular section of having a diameter corresponding to the diameter of the punch out of the end wrapper or binder. Further pressure on the plunger 11 results in extension of the elongated, needle or spike-like piercing member 5 to a desired depth within the cigar, thereby allowing the user to control the depth of the passage formed in the cigar according to the user's preference and the characteristics of the cigar being pierced.

Figure 3:
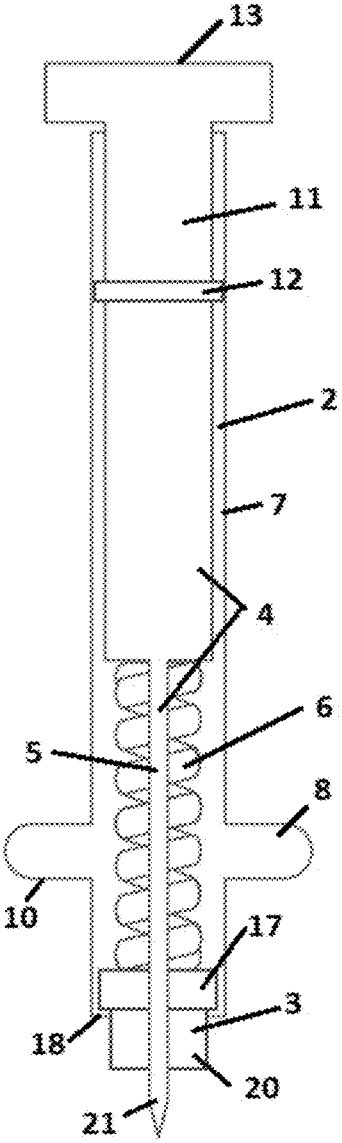
Figure 4:
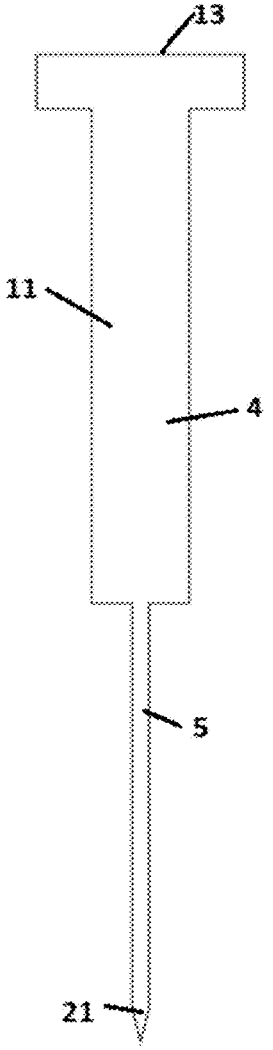
FIG. 4 is a side view of an actuator and elongated piercing member for the cigar ventilation implement of FIGS. 1-4.
Figure 5B:
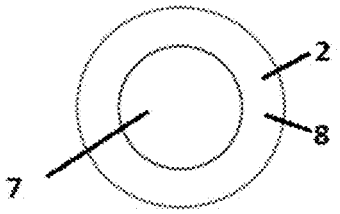
FIG. 5B is an end view of the housing of FIG. 5A.
Figure 5A:
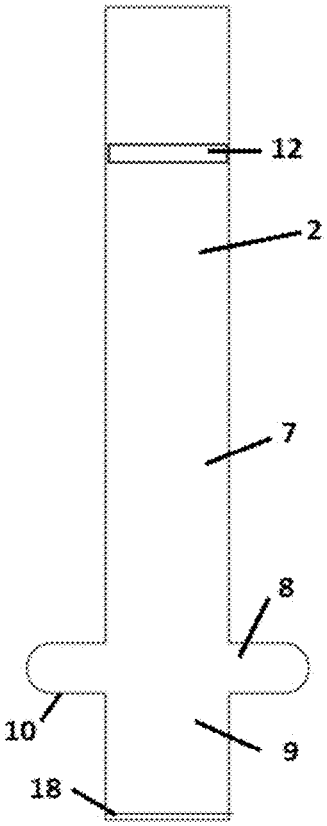
FIG. 5A is a side view of a housing for the cigar ventilation implement of FIGS. 1-4.
Figure 6:
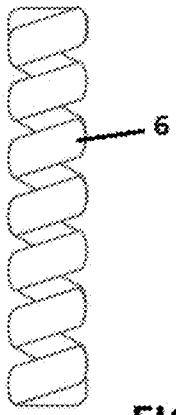
FIG. 6 is a side view of a spring used in the cigar ventilation implement of FIGS. 1-4.
Figure 7B:
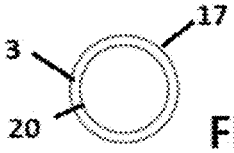
FIG. 7B is an end view of the cylindrical punch of FIG. 7A.
Figure 7A:
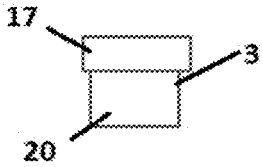
FIG. 7A is a side view of a cylindrical punch for use in the cigar ventilation implement of FIGS. 1-4.

Release of the initial pressure on the plunger 11 results in immediate retraction of the elongated needle or spike-like piercing member 5, i.e., movement is a second direction opposite the first direction, from the position shown in FIG. 3 to the position shown in FIG. 2, in response to the restoring force provided by the compressed coil spring 6. At this time, the tip 21 no longer extends from the punch, eliminating any hazard posed by the relatively sharp tip. Further retraction of the punch 3 and piercing member 5 back into the outer housing 2 (from the position shown in FIG. 2 to the position shown in FIG. 1) may be accomplished by manually pulling up on the plunger 11, by manually pushing up on the punch 3 or down on the housing 2 while the punch 3 engages a surface or, optionally, by the inclusion of a second spring or biasing member (not shown) connected between the plunger 11 and the outer housing 2.

While the outer housing 2 is illustrated as having a shape similar to that of a medical syringe, it will be appreciated that the shape of the outer housing may be varied, and that the implement may be combined or integrated with other objects or devices including, by way of example and not limitation, a conventional cigar cutter, a pocket or utility knife, a key ring, and/or a flashlight. Other possible variations include, by way of example and not limitation, variations in the shape of the tip 21 of the elongated piercing member 5, which may be rounded or flat rather than pointed; and/or variations in the shape of the distal or cutting end of the punch 3

Figure 8C:
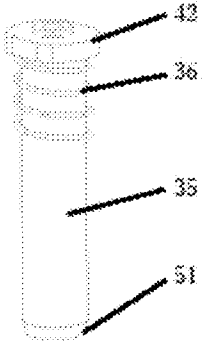
FIGS. 8A-8C are isometric views of a housing/actuator assembly, a piercing member, and punch constructed in accordance with the principles of a second preferred embodiment of the invention.
Figure 8B:
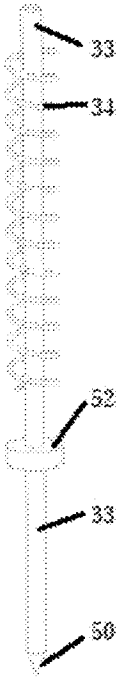
Figure 8A:
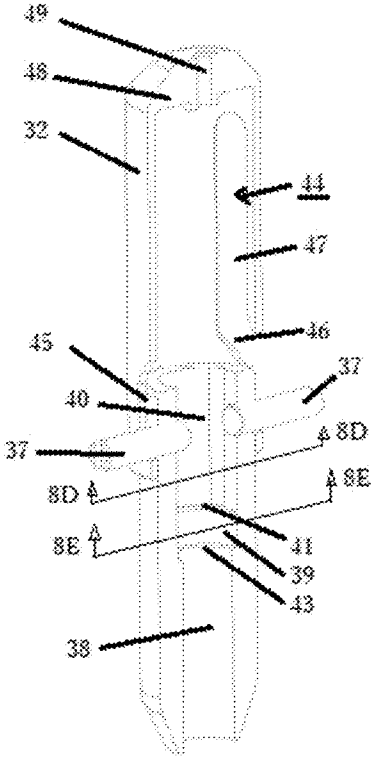

The cigar ventilating implement 30 of a second preferred embodiment of the invention, illustrated in FIGS. 8A-8C, 9A-9C and 10A-10C, includes an lower housing 31 and actuator 32, both shown in FIG. 8A, a piercing member 33 and needle biasing coil spring 34 illustrated in FIG. 8B, and a cylindrical punch 35 and punch biasing coil spring 36 illustrated in FIG. 8C.

As best shown in FIGS. 8A and 10A-10C, the lower housing 31 includes a pair of lateral extending pins 37 that are gripped by the user in order to provide leverage for exerting a downward force on the actuator 32, in order to overcome opposing forces provided by respective coil springs 34 and 36, as described below. Lower housing 31 further includes an inner passage divided into a cylindrical lower section 38, an upper section 40 having a non-circular horizontal cross-section whose shape corresponds to that of a non-circular retaining member 42 at an upper end of the punch 35 to permit linear, non-rotating movement of the punch 35 in a vertical direction relative to the lower housing 31, and a cylindrical intermediate latching section 39 having a diameter that equals or is slightly larger than a largest horizontal cross-sectional dimension L of the non-circular retaining member to permit rotation of the non-circular retaining member 42 and punch 35 relative to the lower housing 31, an upper end of the intermediate latching section including a downwardly facing surface or shelf 41 that engages an upper surface of the retaining member 42 upon rotation of the retaining member 42 to latch the punch 35 in the extended position shown in FIGS. 9B and 10B. The intersection between the lower section 38 and the intermediate section 39 is defined by an annular shoulder or shelf 43 for supporting needle bias spring 34.

Also as shown in FIG. 8A, actuator 32 is a generally cylindrical member having an inner diameter that is slightly larger than an outer diameter of at least an upper part of the lower housing 33, so that the actuator 32 fits over and is linearly movable relative to the lower housing 33. In addition, the actuator 32 includes a pair of guide slots 44 each having a vertically extending linear upper section 45, a vertically extending linear lower section 46, and a sloped or angled intermediate section 47. The top section 48 of the actuator 32 is closed to provide a surface for exerting downward force on the actuator, for example, by the user's thumb or palm, when pins 37 are gripped by the user's fingers. Top section 48 also includes a hole 49 for receiving and fixing a top end of the piercing member 50 relative to the actuator 32, the lower end of the piercing member including a conical or pointed tip 50, shown in FIG. 8B. As illustrated in FIG. 8C, the non-circular retaining member 42 is at an upper end of the punch 35, and a cutting edge 51 is provided at the lower end.

Figure 9C:
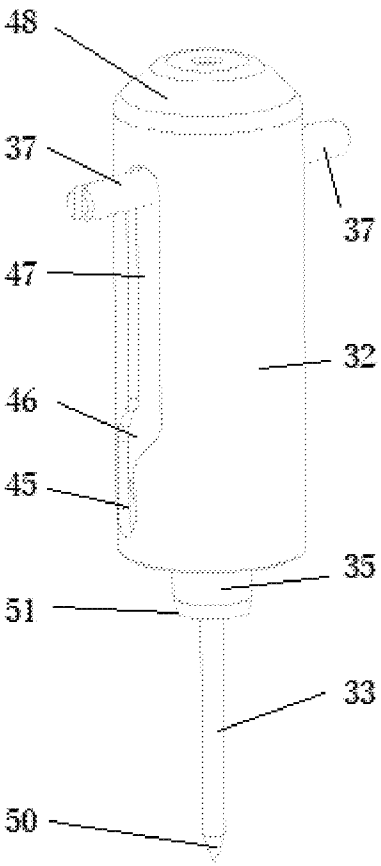
FIGS. 9A-9C of the cigar ventilating implement of the second preferred embodiment, respectively showing a retracted state, a punch extension state, and a piercing member extension state.
Figure 9B:
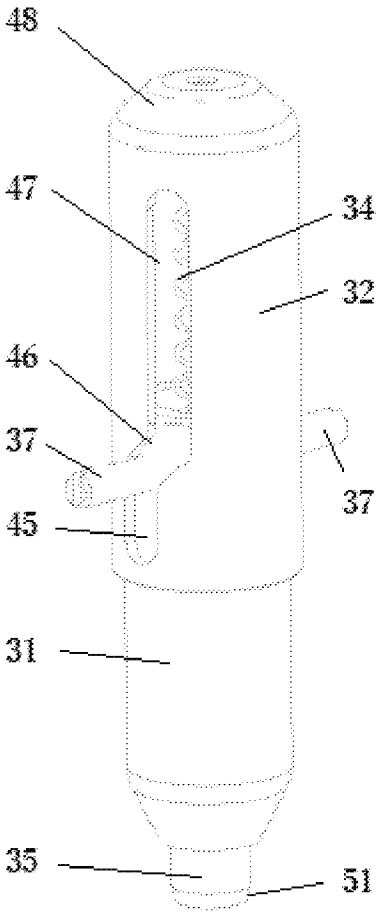
Figure 9A:
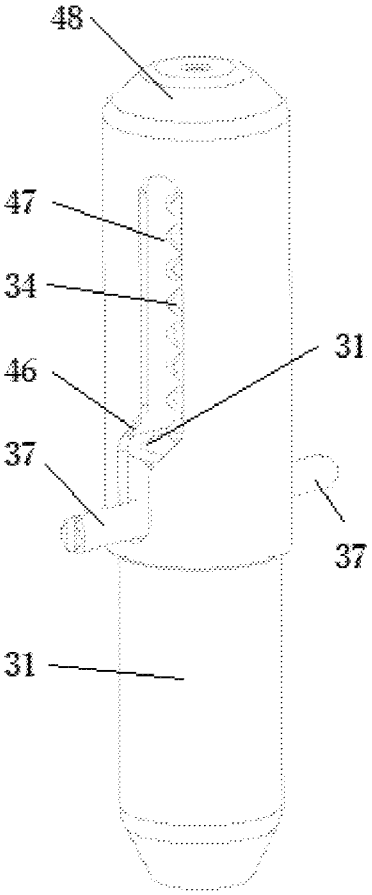
Figure 10C:
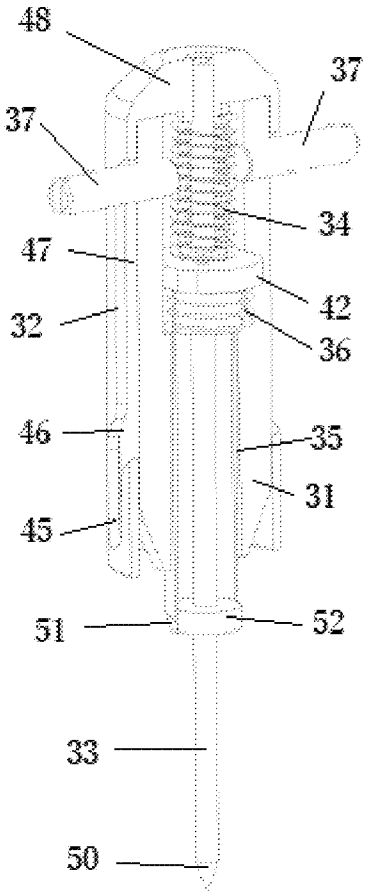
FIGS. 10A-10C are cross-sectional side view of the cigar ventilation implement of the second preferred embodiment, in the respective states illustrated in FIGS. 9A-9C.
Figure 10B:
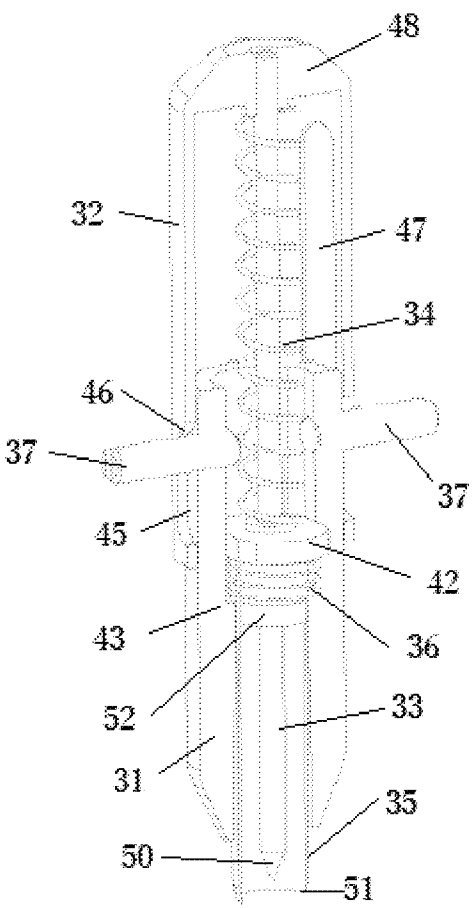
Figure 10A:
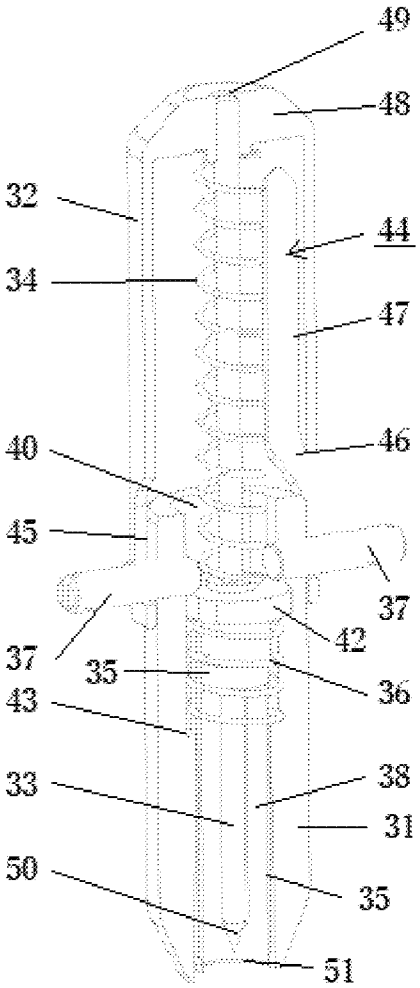

In the initial position shown in FIGS. 9A and 10A, the actuator 32 is at its uppermost position relative to the lower housing 31, pins 37 are at the bottom of the lower sections 45 of slots 44, springs 34 and 36 are extended. As a result, piercing member 33 and punch 51 are in a fully retracted position, in which the pointed tip 50 of the piercing member 33 and the cutting edge 51 of the punch 35 are completely within the lower housing 31. The lower end of spring 36 rests against the shoulder 43 while the upper end of spring 36 is captured by the lower surface of non-circular retaining member 42 of punch 35. In addition, the lower end of spring 34 rests against the upper surface of non-circular retaining member 42 while the upper end of spring 34 is engages a lower surface of top section 48 of the actuator 32.

In this embodiment, the second coil spring 36 that surrounds the punch is stiffer than the first coil spring 34 that surrounds the piercing member 33 so that downward pressure on the actuator 32 causes both the coil spring 34 and punch 35 to move correspondingly downwardly while compressing coil spring 36. As the actuator moves downwardly, pins 37 travel upwardly with respect to the lower section 45 of the slot 44.

Figure 8D:
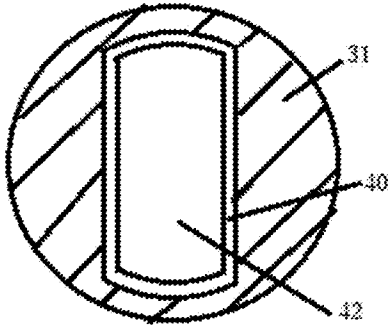
FIGS. 8D and 8E are bottom views respectively taken along lines 8D-8D and 8E-8E in FIG. 8A to show an upper passage and an intermediate passage in the lower housing of the embodiment of FIGS. 8A-8C, together with a retaining member.
Figure 8E:
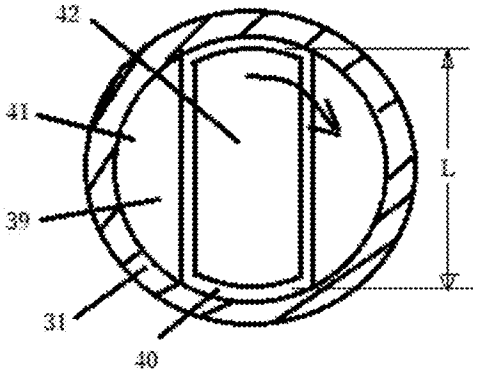

At the point where pins 37 reach the angled intermediate section 47 of slot 44, the punch 35 will have moved vertically downwardly so that the non-circular retaining section 42 exits the upper section 40 of the lower housing inner passage and enters the cylindrical intermediate section 39 of the inner passage. Because the horizontal cross-sectional shape of upper section 40 matches the horizontal shape of the non-circular retaining section 42, movement of the punch while in the non-circular upper section 40 of the lower housing inner passage is limited to vertical movement without rotation, as is apparent in the cross-section shown in FIG. 8D. However, when the non-circular retaining member enters the cylindrical intermediate section 39, as shown in FIG. 8E, the retaining member 42 is able to rotate relative to the lower housing 31 by a small angle in response to the pin 37 entering the intermediate angled section 46 of slot 44. This relative rotation moves a portion of the retaining member 42 under the shelf 41 so that the upper surface of retaining member 42 engages the lower surface of shelf 41, effectively latching the punch 35 in the extended position shown in FIGS. 9B and 10B. At this time, the coil spring 36 is in a fully compressed state.

Because the spring 36 is in a fully compressed state, further movement actuator in a downward direction causes compression of the coil spring 34 and relative movement of the piercing member 33 with respect to the lower housing 31 and punch 35, so that the piercing member is extended out of the lower housing 31. Extension of the punch 35 from the lower housing 31 continues until pins 37 reach the upper ends of linear sections 47 of slots 44, at which time further movement of the actuator 32 is no longer possible and the piercing member 33 is fully extended to the position shown in FIGS. 9C and 10C.

Release of pressure on the actuator 32 will initially result in reverse movement of actuator 31 and slots 44 relative to pins 37 in response to the restoring force provide by coil spring 34, and therefore automatic retraction of the piercing member 33 into the housing. As the pins 37 pass the angled intermediate sections 47 of slots 44, the retaining member 42 rotates to allow it to reenter upper section 45 of the inner passage of lower housing 31, resulting in automatic retraction of punch 51 into the lower housing 31 in response to the restoring force exerted by expansion of coil spring 36.

Optionally, the piercing member 33 may be provided with a disc 52 that serves to clear the punch 35 by pushing any trapped tobacco out of the end of the punch 51 as the piercing member 33 is moved from the position shown in FIGS. 9B and 10B to the position shown in FIGS. 9C and 10C.

As with the first preferred embodiment of the invention, it will be appreciated that numerous variations and modifications are possible without departing from the scope of the invention. For example, the shape of the outer housing may again be varied, or the implement may be combined or integrated with other objects or devices such as, by way of example and not limitation, a conventional cigar cutter, a pocket or utility knife, a key ring, and/or a flashlight.

What is claimed is:

1. A cigar ventilating implement, comprising:

a housing;

an actuator axially movable with respect to the housing;

an elongated piercing member fixed to and axially movable with the actuator to extend from and retract into the housing upon corresponding movement of the actuator;

a first coil spring surrounding the elongated piercing member; and a cylindrical punch coaxial with the elongated piercing member and extendable from the housing by a predetermined distance;

wherein pressing of the actuator in a first direction initially causes the cylindrical punch and elongated piercing member to be moved together to an intermediate position in which the cylindrical punch is extended from the housing, and in which a tip of the elongated piercing member is within the cylindrical punch, wherein continued pressing of the actuator causes the elongated piercing member to move against an oppositely directed bias provided by the first coil spring, resulting in extension of the elongated piercing member from the cylindrical punch by a distance corresponding to a distance that the actuator is moved by a user, the oppositely directed bias causing the elongated piercing member to retract into the cylindrical punch when pressure on the actuator by the user is no longer applied.

2. The cigar ventilating implement as claimed in claim 1, wherein the elongated piercing member is a needle or spike.

3. The cigar ventilating implement as claimed in claim 1, further comprising a second coil spring surrounding the punch, wherein a lower end of the second coil spring rests on an annular shelf in the housing.

4. The cigar ventilating implement as claimed in claim 3, wherein the first coil spring is stiffer than the second coil spring such that initial movement of the actuator in an extension direction causes the second coil spring to compress as the punch is extended, wherein further extension of the punch is limited by maximum compression of the second coil spring, and wherein subsequent movement of the actuator causes the first coil spring to compress, resulting in relative movement between the piercing member and the punch and extension of the piercing member from the housing and the extended punch.

5. The cigar ventilating implement as claimed in claim 4, wherein the punch is latched in the extended position by a rotation movement of the actuator relative to the housing and the punch.

6. The cigar ventilating implement as claimed in claim 4, further comprising a gripping structure that extends radially outward from the cylindrical housing and has a lower surface configured to be gripped by fingers of the user as the user presses on the actuator in the first direction to cause the elongated piercing member and the cylindrical punch to extend from the housing.

7. The cigar ventilating implement as claimed in claim 6, wherein the gripping structure includes at least one pin fixed to the housing and extending through a corresponding at least one vertical slot in the actuator, movement of the actuator relative to the housing to extend and retract the punch and the piercing member being guided by relative movement between the at least one pin and the at least one slot.

8. The cigar ventilating implement as claimed in claim 7, wherein the cylindrical punch includes a retaining member having a horizontal cross-section with a predetermined non-circular shape, wherein the vertical slot includes a lower first vertically-extending linear section, a second vertically-extending linear section, and an angled intermediate section;

wherein the housing includes an inner passage that includes a cylindrical lower section, an upper section having a non-circular shape corresponding to the predetermined non-circular shape of the retaining member, and a cylindrical intermediate section located between the first and second sections and having a diameter at least equal to a largest horizontal cross-sectional dimension of the retaining member, the intermediate section including an inwardly extending latching surface at an upper end;

wherein when the retaining member is within the upper section of the inner passage, the retaining member is constrained to move vertically without rotation; and wherein when the retaining member is within the intermediate section of the inner passage, the retaining member is rotatable relative to the housing in response to relative movement between the at least one pin and the angled intermediate section of the vertical slot, causing an upper surface of the retaining member to be retained by the latching surface of the intermediate section of the inner passage to latch the punch in an extended position.

9. The cigar ventilating implement as claimed in claim 1, further comprising a gripping structure that extends radially outward from the housing and has a lower surface configured to be gripped by fingers of the user as the user presses on the actuator in the first direction to cause the elongated piercing member and the cylindrical punch to extend from the housing.

10. The cigar ventilating implement as claimed in claim 9, wherein the gripping structure includes at least one pin fixed to the housing and extending through a corresponding at least one vertical slot in the actuator, movement of the actuator relative to the housing to extend and retract the punch and the piercing member being guided by relative movement between the at least one pin and the at least one slot.

11. The cigar ventilating implement as claimed in claim 1, wherein the implement has a syringe configuration, the actuator serving as a plunger slidably supported within the housing by a bearing.

12. The cigar ventilating implement as claimed in claim 11, wherein the cylindrical punch includes a laterally extending projection or collar that engages an inwardly extending flange or shoulder at a lower end of the housing to limit movement of the cylindrical punch out of the housing to the predetermined distance, wherein pressing of the actuator in a first direction when the actuator is in a topmost position causes the cylindrical punch, the first coil spring, and the elongated piercing member to be moved together to the intermediate position in which:

the laterally extending projection or collar of the cylindrical punch engages the inwardly extending flange or shoulder of the housing, the cylindrical punch is extended from the outer housing, and the tip of the elongated piercing member is within the cylindrical punch, and wherein continued pressing of the actuator after the laterally extending projection or collar of the cylindrical punch has engaged the shoulder of the outer housing in the intermediate position causes the actuator and elongated piercing member to move against the oppositely directed bias provided by the first coil spring, resulting in extension of the elongated piercing member from the cylindrical punch by the distance corresponding to the distance that the actuator is moved by the user, the oppositely directed bias causing the elongated piercing member to retract into the cylindrical punch when pressure on the actuator by the user is no longer applied.

13. The cigar ventilating implement as claimed in claim 1, wherein the implement further includes a punch cleaning member for removing tobacco remaining in the punch after cutting.

14. The cigar ventilating implement as claimed in claim 13, wherein the punch cleaning member is a disc fixed to the piercing member and configured to reach a lower end of the punch when the piercing member is extended.

* * * * *